US010228661B2

(12) United States Patent
Dépraz

(10) Patent No.: US 10,228,661 B2
(45) Date of Patent: Mar. 12, 2019

(54) CHRONOMETRIC TESTING METHOD OF A TIMEPIECE

(71) Applicant: ROLEX SA, Geneva (CH)

(72) Inventor: Raphaël Dépraz, Penthalaz (CH)

(73) Assignee: ROLEX SA, Geneva (CH)

( * ) Notice: Subject to any disclaimer, the term of this patent is extended or adjusted under 35 U.S.C. 154(b) by 150 days.

(21) Appl. No.: 15/240,413

(22) Filed: Aug. 18, 2016

(65) Prior Publication Data

US 2017/0060097 A1 Mar. 2, 2017

(30) Foreign Application Priority Data

Aug. 24, 2015 (EP) ..... 15182210

(51) Int. Cl.
*G04D 7/00* (2006.01)

(52) U.S. Cl.
CPC ..... *G04D 7/00* (2013.01); *G04D 7/006* (2013.01)

(58) Field of Classification Search
CPC ..... G04D 7/00; G04D 7/006
See application file for complete search history.

(56) References Cited

U.S. PATENT DOCUMENTS 2,841,978 A * 7/1958 Kohn ..... G04D 7/006 475/11
5,245,875 A * 9/1993 Tyrode ..... G04D 7/00 29/10
2013/0329040 A1 12/2013 Willemin et al.
2016/0070236 A1 3/2016 Willemin et al.

FOREIGN PATENT DOCUMENTS

CH 704 688 A2 9/2012
CH 707 013 A1 3/2014
EP 2 458 458 A1 5/2012
FR 320220 A 12/1902

OTHER PUBLICATIONS

Contrôle Officiel Suisse des Chronomètres: "Chronomètre mécanique", 1976, excerpted from http://www.cosc.ch/chronometre2.php?lang=frXP002755564; with English machine translation; cited in the ISR (4 pages).
European Search Report and Written Opinion dated Apr. 13, 2016 issued in counterpart application No. EP15182210; w/ English partial translation and partial machine translation (24 pages).
J.-C. Beuchat et al., "Measurement of certain wristwatch wearing conditions: temperature, magnetic fields, accelerations due to impacts, positions", Annual Bulletin of the SSC and LSRH, vol. V, 1969, pp. 753-761; with English abstract and machine translation (16 pages); cited in the Specification.

(Continued)

*Primary Examiner* — Paul M. West
*Assistant Examiner* — Mark A Shabman
(74) *Attorney, Agent, or Firm* — Westerman, Hattori, Daniels & Adrian, LLP

(57) ABSTRACT

A chronometric testing or chronometric certification method for a timepiece (1), comprising at least two status reports of the timepiece before and after at least a first static storage cycle in one or multiple predefined positions of the timepiece, said first static storage cycle comprising at least a first inclined position (γ) of the timepiece.

23 Claims, 3 Drawing Sheets

(56) References Cited

OTHER PUBLICATIONS

D. Jacquet, "Chronometric incidences of wearing a wristwatch with spring balance oscillator—Applications to the probable diurnal rate calculation", Act No. 20 of the 52nd Congress of the SSC, 1977, pp. 321-329; with English machine translation (17 pages); cited in the Specification.

J.-P. Bernet et al., "Average wear static simulation of the wristwatch—Effect on the diurnal rate", Act of Conference No. B2.4 of the CIC, 1979, pp. 227-235; with English machine translation (20 pages); cited in the Specification.

International Standard ISO 3158 "Timekeeping instruments—Symbolization of control positions", Int'l Organization for Standardization, Geneva (Switzerland), 1st Ed., Feb. 1, 1976; in English (8 pages); cited in the Specification.

German Norm DIN 8319-1 "Chronometer", Beuth Verlag GmbH, Berlin (Germany), Oct. 1980; w/ English machine translation (6 pages); cited in the Specification.

EPO Office Action dated Oct. 8, 2018 in counterpart application No. EP 15182210.3, enclosing third party observation; in English (3 pages).

Meissner et al., "Un nouvel équipement de mesures de l'organe réglant pour la montre mécanique" ["New equipment for measuring the regulating organ for the mechanical watch"], Congrès International de Chronométrie 2007 [International Congress on Chronometry 2007], pp. 45-51, Colombier, Switzerland, Sep. 26-27, 2007; with English machine-translation (14 pages).

* cited by examiner

CHRONOMETRIC TESTING METHOD OF A TIMEPIECE

The invention relates to a chronometric testing and/or chronometric measurement and/or chronometric certification method of a timepiece or a watch movement. It also relates to a chronometric testing and/or chronometric measurement and/or chronometric certification procedure for a timepiece or a watch movement implementing such a method. It also relates to a method for producing or manufacturing or adjusting a timepiece or a watch movement. Finally, it relates to a watch movement or a timepiece, notably a wristwatch, obtained by such a production, manufacturing or adjustment method. The invention also relates to a device for chronometric testing and/or chronometric measurement and/or chronometric certification of a timepiece or a watch movement.

Operational precision is an essential criterion for a wristwatch. It can vary greatly depending on the design of the watch, the quality of the components, the care taken in assembly and adjustment, but also on the conditions of wear.

Several labels and certificates, independent or proprietary, are provided to certify, among other things, the operational precision of watch movements or finished products. These can result from tests based on standards or be based on some other method. Depending on these tests, the precision of the movement or of the watch can be measured in static mode according to five or six predefined positions, known as "watch positions", or in dynamic mode on an installation capable of reproducing the specific movements of a given wearer.

Among the contemporary certifications, the standards-based Swiss (COSC certificate) and German (LMET/SLME certification) official certifications are explicitly detailed. They foresee status reports solely in five watch positions in different temperature conditions.

The Swiss official certification is guaranteed by the COSC (Contrôle Officiel Suisse des Chronométres) which is an official and independent organization whose mission is to test the precision of watch movements. This applies strictly to standard ISO 3159, which lays down the definition of the term "chronometer" with spring balance oscillator, and movements, and the movements that meet the criteria set by this standard receive an "official chronometer certificate". The movements are observed for fifteen consecutive days, and are subject to a program comprising static storage in various reference watch positions. It is clearly stated that these tests are not intended to simulate the behavior of the movement when the wristwatch is worn. Seven criteria must be met in order for the movement to obtain the certificate.

The German certification is distinguished by the fact that it concerns cased-up watches, and not the movements. This is ensured by the official offices of weights and measures in Thuringia (LMET) and Saxony (SLME), which strictly applies the DIN 8319 standard for the purpose of issuing a "chronometer" certificate. The test program is similar to that of the COSC, namely in that the watches are observed for fifteen days, in five watch positions and at three distinct temperatures. Seven criteria must be met in order for a watch to obtain the certificate. They are similar to the criteria of the COSC.

Patent applications also relate to chronometric measurement or chronometric certification methods for a timepiece or a watch movement.

The patent application EP2458458A1 relates to a method for measuring the precision of a mechanical watch implementing at least a visual display. It is designed to identify and record the configuration of the hands of a timepiece at at least two given moments so as to deduce first and second time values displayed by the timepiece. The rate variation of the timepiece, which is displayed by the device associated with the method, is thus given by the time difference between these two display values which is compared to the time difference given by a third timebase.

The patent application CH704688 relates specifically to a chronograph watch certification process. Such a test is intended to notably verify the chronometry of the chronograph part of the watch, regardless of how the basic movement operates (preferably chronometer-certified beforehand).

The patent application CH707013 also discloses a chronometric qualification protocol of a timer. It is stated that two rate measurements can be performed: one in the "CH" position and the other in the "6H" position according to standard ISO 3158.

A certain number of studies have also been conducted to better understand the wearing conditions of wristwatches and their chronometry.

J.-C. Beuchat, A. Botta and R. Grandjean, in "Mesure de certaines conditions du porter de la montre-bracelet: temperature, champs magnétiques, accélérations dues aux chocs, positions" (Measurement of certain wristwatch wearing conditions: temperature, magnetic fields, accelerations due to impacts, positions) (Annual bulletin of the SSC and LSRH, Vol. V; 1969), notably focus on experimentally understanding the operating time of a wristwatch in a given position when worn. To do this, a position sensor with a format similar to that of a wristwatch was created, and was worn on the wrist by four experimenters for a period of nine days. Only the time spent by the detector in the six watch positions are determined. Thus, the acquisition time does not reflect the actual wearing time, and does not allow to determine if a privileged wearing position stands out from fundamental watch positions. The authors do not provide a conclusion, and only indicate that the "HH" and "VG" positions ("Cadran Haut" (dial up) and "6H" (stem left) respectively, in accordance with the designation in standard ISO 3158) should predominate.

D. Jacquet, in "Incidences chronométriques du porter de la montre-bracelet sur un oscillateur à balancier spiral—Applications au calcul de la marche diurne probable" (Chronometric incidences of wearing a wristwatch with spring balance oscillator—Applications to the probable diurnal rate calculation) (Act No. 20 of the $52^{th}$ congress of the SSC; 1977), describes an expression of the probable rate of the watch based on the various instantaneous rates recorded in the six watch positions, and weighted by coefficients representing the probability that these configurations exist when worn.

J.-P. Bernet, A. Hoffmann, in "Simulation statique du porter moyen de la montre-bracelet—Effet sur la marche diurne" (Average wear static simulation of the wristwatch—Effect on the diurnal rate (Act of conference No. B2.4 of the CIC; 1979), disclose a series of experimental tests to implement the model described in the abovementioned document. In a first approach, the weighting coefficients are derived from the probabilistic theory of D. Jacquet, which leads to certain negative weighting values. It is therefore difficult to establish a correlation between the wearing reality and theory of the model. In a second approach, the weighting coefficients are extracted from the experimental device of J.-C. Beuchat, A. Botta and R. Grandjean, in "Mesure de certaines conditions du porter de la montre-bracelet:température, champs magnétiques, accélérations dues aux chocs, positions" (Measurement of certain wristwatch wearing conditions: temperature, magnetic fields, accelerations due to impacts, positions) (Annual Bulletin of the SSC and LSRH, Vol. V: 1969), which are not representative of actual wearing.

The purpose of the invention is to provide a chronometric testing method which improves the testing methods known from the prior art. In particular, the invention proposes a testing method that better reflects wristwatch wearing conditions.

A timepiece chronometric testing or chronometric certification method according to the invention is defined as a chronometric testing or chronometric certification method for a timepiece, comprising at least two status reports of the timepiece before and after at least a first static storage cycle in at least one predefined position of the timepiece, the at least one predefined position comprising at least a first inclined position (γ) of the timepiece.

Different embodiments of the method are defined as follows:

the method as above, wherein the first inclined position (γ) is defined by a first angle λ and by a second angle ϑ such that λ∈[135°, 225°] and ϑ∈[20°, 85°], particularly such that λ∈[135°, 225°] and ϑ∈[20°, 70°], notably such that λ∈[135°, 225°] and ϑ=45°, with:

a first direct coordinate system (O, i, j, k) with an origin (O) at the center of a dial of the timepiece, a first oriented semi-axis (Oi), horizontal and fixed in direction, a second oriented semi-axis (Oj), horizontal and fixed in direction and a third oriented semi-axis (Ok), vertical, fixed in direction and opposite the gravitational field vector (g), a first position of the timepiece in which the first semi-axis (Oi) passes through a 9 o'clock mark of the dial and the third semi-axis (Ok) passes through a 12 o'clock mark of the dial, any position of the timepiece is defined from the first position by a rotation of the angle λ about the second semi-axis (Oj), then a rotation of the angle ϑ about the first semi-axis (Oi), λ being defined on an interval between 0° and 360°, ϑ being defined on an interval between −90° and 90°;

a method as above, wherein the first position (γ) is such that the angle λ is equal to or substantially equal to 180°, a method as above, wherein:

the first static storage cycle further comprises at least one storage phase in one of the conventional watch positions, notably a second 3H position (λ=90°; ϑ=0°) and/or a third 6H position) (λ=180°; ϑ=0°) and/or a fourth 9H position (λ=270°; ϑ=0°) and/or a fifth 12H position (λ=0°; ϑ=0°) and/or a sixth CH position (ϑ=90°) and/or a seventh FH position (ϑ=−90°) and/or at least a second inclined position (γ') and/or the method comprises a second storage cycle of the timepiece, notably a second dynamic storage cycle of the timepiece in which the timepiece sweeps a given continuum of positions;

a method as above, wherein for a storage cycle of a duration (t), the respective storage times ($t_\gamma$), ($t_{3H}$), ($t_{6H}$), ($t_{9H}$), ($t1_{2H}$), ($t_{FH}$), ($t_{CH}$) associated with each position (γ), (3H), (6H), (9H), (12H), (FH), (CH) of the timepiece are defined as follows:

$$\Sigma t_k = t \text{ with } k \in \{\gamma, 3H, 6H, 9H, 12H, FH, CH\}$$

with:

$$\begin{cases} t_\gamma = a \cdot t \text{ with } 0.05 \le a \le 0.85 \\ t_{3H} = b \cdot t \text{ with } 0 \le b \le 1 \\ t_{6H} = c \cdot t \text{ with } 0 \le c \le 1 \\ t_{9H} = d \cdot t \text{ with } 0 \le d \le 1 \\ t_{12H} = e \cdot t \text{ with } 0 \le e \le 1 \\ t_{FH} = f \cdot t \text{ with } 0 \le f \le 1 \\ t_{CH} = g \cdot t \text{ with } 0 \le g \le 1 \end{cases}$$

in particular:

$$t_\gamma = a \cdot t \text{ with } 0.1 \le a \le 0.4$$

notably:

$$t_\gamma = a \cdot t \text{ with } 0.15 \le a \le 0.35$$

a method as above, wherein:

$$\begin{cases} 0.3 \le b + c + d + e \le 0.85 \\ 0.1 \le f + g \le 0.4 \end{cases}$$

a method as above, wherein:

$$\begin{cases} a \ne b \\ a \ne c \\ a \ne d \\ a \ne e \\ a \ne f \\ a \ne g \end{cases}$$

a method as above, wherein the temperature and/or pressure conditions change over the duration (t) of the storage cycle, notably depending on the storage phases of the timepiece, in particular depending on the static storage phases of the timepiece and/or wherein an auxiliary watch function, notably a chronograph function or a calendar function, is activated during all or part of the duration (t) of the storage cycle;

a method as above, wherein a rate variation of the timepiece is measured and given by the time difference between:

a time difference between two display values of the timepiece during at least two status reports of the timepiece, and a time difference between the instants of the at least two status reports of the timepiece, given by a reference timebase.

A device according to the invention is defined as a chronometric testing or chronometric certification device of a timepiece, comprising hardware elements and/or software implementing a method as above.

Embodiments of the device are defined as follows:

the device as above, comprising static storage elements of at least one timepiece in at least the first position;

the device as above, comprising displacement elements of the timepiece to sweep the timepiece in a continuum of positions in space, the displacement elements comprising a system having at least one axis of rotation, for example.

A timepiece production or adjustment method according to the invention is defined as a production or adjustment method of a timepiece, the method comprising an implementation step of the chronometric testing method as above.

An embodiment of the production or adjustment method is defined as a production or adjustment method as claimed in the preceding claim, the method comprising at least one adjustment step, notably an adjustment step dependent on the rate variation provided by the method as above.

A timepiece or a movement according to the invention is defined as a timepiece, notably a wristwatch, obtained by implementing a method as above.

The accompanying drawings illustrate, by way of examples, embodiments of methods and devices according to the invention.

As the rate precision of a timepiece is particularly dependent on the conditions of wear, a test should be proposed aiming to be more representative of how the wristwatch is actually worn. To this end, the work of the applicant combined an initial study to understand the behavior of the watch in the field of gravity and a second study to understand the statistical behavior of the watch when worn. These studies have demonstrated that it was possible to optimize the representativeness of such a test by optimizing the static storage of the timepiece which includes one or several positioning phases of the timepiece.

More particularly, these studies have led to the implementation of a testing or certification method of a timepiece that is distinguished by the fact that it comprises, in addition to positioning phases of the timepiece in conventional watch positions, a positioning phase of the timepiece in another position, referred to as the "intermediate position" or "position $\gamma$" or the "inclined position". The storage time of the timepiece in each position can be optimized in order to come as close as possible to the positions of the timepiece when it is actually being worn by a wearer.

According to one embodiment of the invention, the testing or certification method includes at least two status reports of the timepiece before and after at least one static storage cycle. The term "static storage cycle" refers to one or more positioning phases of the timepiece in a predefined position.

Figure 1:
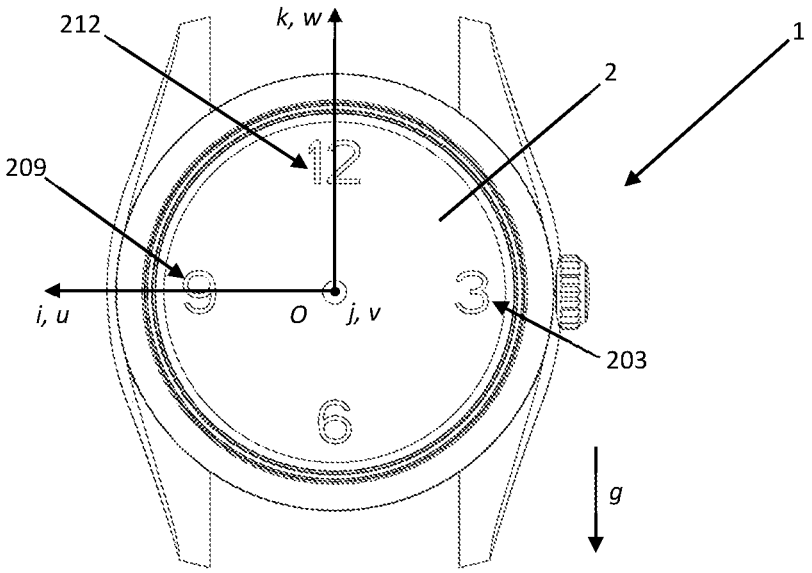
FIG. 1 is an illustration of a timepiece in watch position 12H, i.e. $\lambda=0°$ and $\vartheta=0°$ according to standard ISO 3158.
Figure 2:
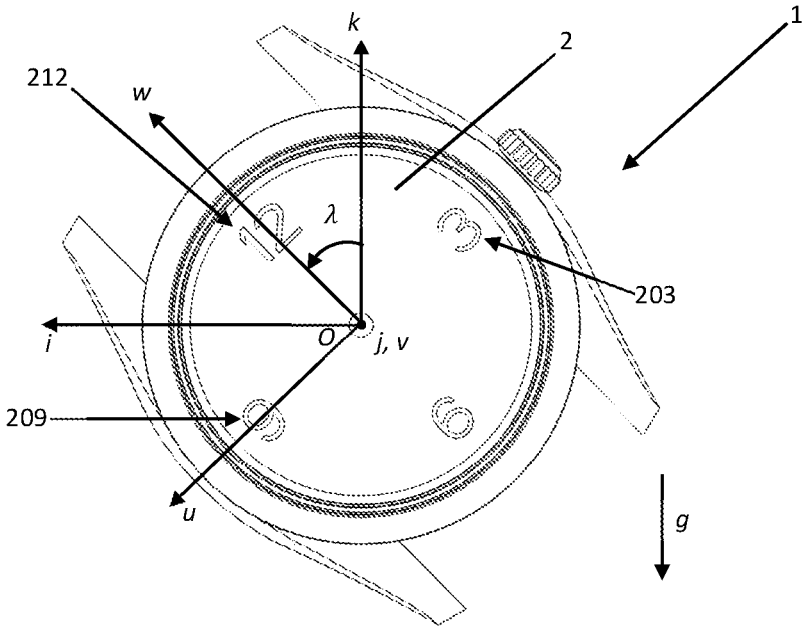
FIG. 2 is an illustration of the timepiece in non-zero $\lambda$ position and $\vartheta=0°$ according to standard ISO 3158.
Figure 3:
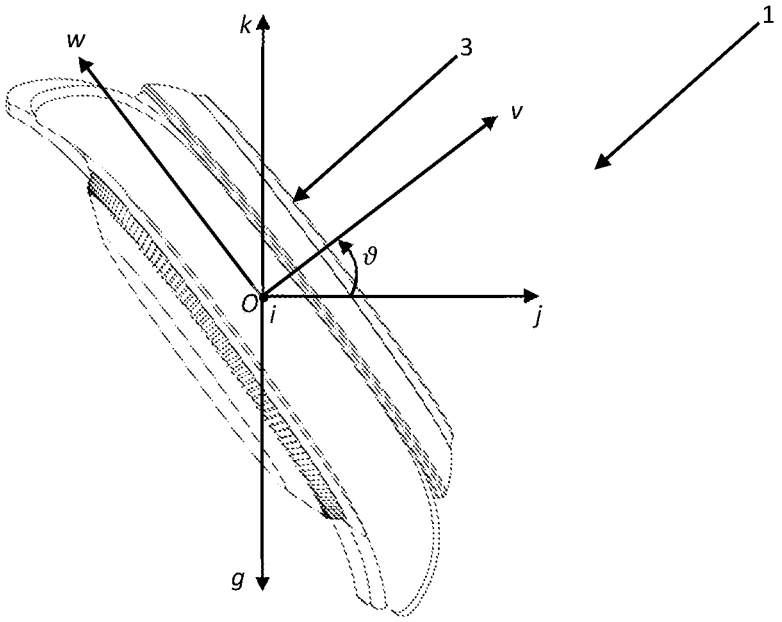
FIG. 3 is an illustration of the timepiece in non-zero $\vartheta$ position according to standard ISO 3158.

The position of the timepiece in space is defined, as in standard ISO 3158, by two rotations from a specified position of origin. For this purpose, two orthogonal coordinate systems R1 and R2 are considered, as illustrated in FIGS. 1 to 3. It is also considered that the timepiece 1 has a conventional plane dial 2 (even if this is not the case, as will be seen below and as is also described in ISO 3158).

The first orthogonal coordinate system R1 (O, i, j, k) is a fixed and direct coordinate system, with O as the origin at the center of the dial 2 of the timepiece 1. The vectors i and j are horizontal. The vector k is vertical and opposite the vector g of the Earth's gravitational field. The vectors i and j thus define a plane perpendicular to the vector k.

The second orthogonal coordinate system R2 (O, u, v, w) is a rotating coordinate system that is associated with the timepiece 1. The orthogonal coordinate system R2 (O, u, v, w) is a direct coordinate system. The vector u is a vector parallel to the plane of the dial such that a line passing through the origin O and oriented along this vector passes through the mark 209 corresponding to the 9 o'clock indication on the dial 2. The vector v is a vector perpendicular to the plane of the dial 2 and oriented from the plane of the dial 2 toward the glass 3 of the timepiece 1. The vector w is a vector parallel to the plane of the dial, such that a line passing through the origin O and oriented along this vector, passes through the mark 212 corresponding to the 12 o'clock indication on the dial 2.

In an initial position of the timepiece corresponding to the designation 12H according to ISO 3158, as shown in FIG. 1, the vectors u, v, w are merged with the vectors i, j, k, respectively, i.e. the dial of the timepiece is parallel to the gravitational field, the oriented semi-axes Oi (designated "Oi" as it passes through the origin O and is oriented along the vector i) and Ok (designated "Ok" as it passes through the origin O and is oriented along the vector k) pass by marks 209 and 212, respectively, of the dial 2, and the vector w is opposite the vector g of the Earth's gravitational field.

Any position of the timepiece is defined by:

- A first oriented angle $\lambda$ (called longitude) between the vectors k and w under the effect of a rotation of the timepiece about the oriented semi-axis Oj, as shown in FIG. 2.
- A second oriented angle $\vartheta$ (called latitude) between the vectors j and v under the effect of a rotation of the timepiece about the oriented semi-axis Oi, as shown in FIG. 3.

from the initial position of the timepiece in position 12H and illustrated in FIG. 1, wherein $\lambda=0°$ and $\vartheta=0°$.

In other words, the angles $\lambda$ and $\vartheta$ can be defined as follows:

$0°\leq\lambda<360°$, with $\lambda$: the positive angle formed upon rotation of the timepiece about the oriented semi-axis Oj perpendicular to the plane of the dial between the vector k opposite the gravitational field and the vector w defined such that a line passing through the origin O of the dial and oriented along this vector passes through the mark corresponding to the 12 o'clock indication on the dial, the timepiece being observed from the dial side, said dial being parallel to the gravitational field.

$-90°\leq\theta\leq90°$, with $\vartheta$: the angle formed upon rotation of the timepiece about the oriented semi-axis Oi between the vector j and the vector v perpendicular to the plane of the dial and oriented from the dial to the glass of the timepiece. Conventionally, $\vartheta=90°$ when the timepiece is arranged in the CH (Dial Up) position, and $\vartheta=-90°$ when the timepiece is arranged in the FH position (Dial Down).

The angles $\lambda$ and $\vartheta$ thus coincide with those defined in standard ISO 3158.

All the positions obtained by rotational symmetry about the axis k can be considered as equivalent.

The process described below was developed to determine the rate precision, notably diurnal rate precision of a timepiece. A rate variation of the timepiece is measured and given by the time difference between:

the time difference between the first and second display values of the timepiece during the first and second status reports, respectively, and the time difference given by a third party reference timebase between the first and second status reports.

Thus, the method comprises at least two status reports of the timepiece before and after at least a first storage cycle in at least one predetermined position of the timepiece, the at least one predefined position being a first inclined position γ of the timepiece. In other words, when the first static storage cycle has a single predetermined position of the timepiece, the predefined position is the first inclined position γ of the timepiece and, when the first static storage cycle has several predefined positions of the timepiece, the predefined positions include at least the first inclined position γ of the timepiece. Again in other words, the first static storage cycle has at least a first inclined position γ of the timepiece.

An inclined position is preferably such that the plane of the dial of the timepiece is neither parallel to the Earth's gravitational field, nor perpendicular to the Earth's gravitational field.

The first inclined position γ is for example such that the normal to the dial (vector v) forms, with the vector g, an angle (non-oriented) of between 110° and 175°, particularly between 110° and 160°, particularly substantially equal to 135°.

The first inclined position is for example such that λ∈[135°, 225°] and ϑ∈[20°, 85°], particularly wherein λ∈[135°, 225°] and ϑ∈[20°, 70°], notably wherein λ∈[135°, 225°] and ϑ=45°, with:

λ: longitude,

ϑ: latitude.

Preferably, the first position γ is such that the angle λ is equal or substantially equal to 180°.

In other words, the storage cycle preferably comprises at least one storage phase in the inclined position γ which can notably be between the CH watch position (such as λ=180° and ϑ=90°) and a vertical watch position, notably the 6H position (such as λ=180° and ϑ=0°) with λ=180° and invariable.

Advantageously, the storage cycle can further comprise at least a storage phase in one of the conventional watch positions, notably in a second position 3H (such as λ=90° and ϑ=0°) and/or a third position 6H (such as λ=180° and ϑ=0°) and/or a fourth position 9H (such as λ=270° and ϑ=0°) and/or a fifth position 12H (such as λ=0° and ϑ=0°) and/or a sixth position CH (such as ϑ=90°) and/or a seventh position FH (such as ϑ=−90°). The storage cycle can also comprise at least a second inclined position γ', different from the position γ, in which λ and ϑ are predetermined. Advantageously, the second inclined position is such that λ∈[135°, 225°] and ϑ∈[20°, 85°], particularly such that λ∈[135°, 225°] and ϑ∈[20°, 70°], notably such that λ∈[135°, 225°] and ϑ=45°.

For a storage cycle, in particular a static storage cycle in different positions, of duration t, the studies of the applicant have also shown that the storage time in the positions could preferably be described in the following manner:

$$\Sigma t_k = t \text{ with } k \in \{\gamma, 3H, 6H, 9H, 12H, FH, CH\}$$

with:

$$\begin{cases} t_\gamma = a \cdot t \text{ with } 0.05 \le a \le 0.85 \\ t_{3H} = b \cdot t \text{ with } 0 \le b \le 1 \\ t_{6H} = c \cdot t \text{ with } 0 \le c \le 1 \\ t_{9H} = d \cdot t \text{ with } 0 \le d \le 1 \\ t_{12H} = e \cdot t \text{ with } 0 \le e \le 1 \\ t_{FH} = f \cdot t \text{ with } 0 \le f \le 1 \\ t_{CH} = g \cdot t \text{ with } 0 \le g \le 1 \end{cases}$$

in particular:

$$t_\gamma = a \cdot t \text{ with } 0.1 \le a \le 0.4$$

notably:

$$t_\gamma = a \cdot t \text{ with } 0.15 \le a \le 0.35$$

preferably:

$$\begin{cases} 0.3 \le b + c + d + e \le 0.85 \\ 0.1 \le f + g \le 0.4 \end{cases}$$

Preferably, the storage cycle is a static storage cycle, i.e. a storage cycle when the timepiece is held stationary in a position in each storage phase.

The storage time in each phase can be equal. Preferably however, the storage times in each positioning phase of the timepiece are not equal so as to obtain the most accurate image possible of how the timepiece is worn.

Advantageously, the temperature and/or pressure conditions may change over the duration t of the at least one first storage cycle, notably depending on the storage phases or storage positions of the timepiece.

An auxiliary watch function, notably a chronograph function or a calendar function, can be activated throughout all or part of the duration t of the storage cycle.

The method may include a second storage cycle of the timepiece, said second storage cycle being provided to sweep the timepiece through a continuum of positions in space.

In a first embodiment, the storage cycle of a duration t reduces to a static storage cycle in one or more predefined positions of the timepiece.

In a second preferred embodiment, the storage cycle may include, besides a static storage cycle in one or more predefined positions of the timepiece, a dynamic storage cycle of the timepiece. The term "dynamic storage" refers to a method of storage of the timepiece enabling it to sweep through a continuum of positions in space, for example by means of a suitable device provided with at least one axis of rotation. The linear speed of the timepiece may or may not be constant.

In this second embodiment, for a storage cycle of duration t consisting of a static storage cycle of duration t' and a dynamic storage cycle of duration t", the storage time in the various positions can be defined as follows:

$$\begin{cases} t_\gamma = t'_\gamma + t''_\gamma \\ t_{3H} = t'_{3H} + t''_{3H} \\ t_{6H} = t'_{6H} + t''_{6H} \\ t_{9H} = t'_{9H} + t''_{9H} \\ t_{12H} = t'_{12H} + t''_{12H} \\ t_{FH} = t'_{FH} + t''_{FH} \\ t_{CH} = t'_{CH} + t''_{CH} \end{cases}$$

with:

$$\Sigma t'_k = t' \text{ with } k \in \{\gamma, 3H, 6H, 9H, 12H, FH, CH\}$$

$$\Sigma t''_k = t'' \text{ with } k \in \{\gamma, 3H, 6H, 9H, 12H, FH, CH\}$$

and:

$$\begin{cases} t_\gamma = a \cdot t \\ t_{3H} = b \cdot t \\ t_{6H} = c \cdot t \\ t_{9H} = d \cdot t \\ t_{12H} = e \cdot t \\ t_{FH} = f \cdot t \\ t_{CH} = g \cdot t \end{cases}$$

$$\begin{cases} t'_\gamma = a' \cdot t' \\ t'_{3H} = b' \cdot t' \\ t'_{6H} = c' \cdot t' \\ t'_{9H} = d' \cdot t' \\ t'_{12H} = e' \cdot t' \\ t'_{FH} = f' \cdot t' \\ t'_{CH} = g' \cdot t' \end{cases}$$

$$\begin{cases} t''_\gamma = a'' \cdot t'' \\ t''_{3H} = b'' \cdot t'' \\ t''_{6H} = c'' \cdot t'' \\ t''_{9H} = d'' \cdot t'' \\ t''_{12H} = e'' \cdot t'' \\ t''_{FH} = f'' \cdot t'' \\ t''_{CH} = g'' \cdot t'' \end{cases}$$

The values of the coefficients a" to g" result from the programming of the dynamic storage device which defines the trajectory of the timepiece in space. More particularly, the values of the coefficients a" to g" are derived from the calculation of the proportion of time that the timepiece spends in each of the positions γ, 3H, 6H, 9H, 12H, FH, and CH, during its dynamic storage.

The chronometric testing or chronometric certification method of a timepiece according to the invention is based on the first and second studies of the applicant.

The first study describes the behavior of the motion in the gravitational field in order to define the extent of all the positions that can be associated with each of the watch positions used in each of the storage phases. This study thus makes it possible to define the transitions between the various watch positions. Owing to the results of this study, it is possible to establish, notably on the basis of a chronometric behavior criterion, a correspondence table between any position of the timepiece and a watch position used during the storage phase of the timepiece. In other words, it is possible to associate a watch position with each position in which the timepiece can be found when worn. In mathematical terms, it is therefore possible to produce a surjective function of all the positions that the timepiece can occupy based on a set of a few reference positions, preferably comprising all or part of the six watch reference positions.

To do this, the rate and the amplitude of several movements were measured for a large number of orientations in space. A development operation consisted in positioning the movements in multiple positions in both latitude and longitude, and in conducting rate and amplitude measurements in each of these positions for a constant winding torque of the barrel.

During a measurement, the longitudes $\lambda_i$ are swept over 360° according to a predetermined angular pitch, before the latitude $\vartheta_j$ is incremented in turn according to a predetermined angular pitch, and so on until a complete latitudinal "back and forth" movement is performed (CH position-FH position-CH position). Rate M ($\lambda_i$, $\vartheta_j$) and amplitude A ($\lambda_i$, $\vartheta_j$) curves for each of the timepiece references tested were thus established.

Figure 4:
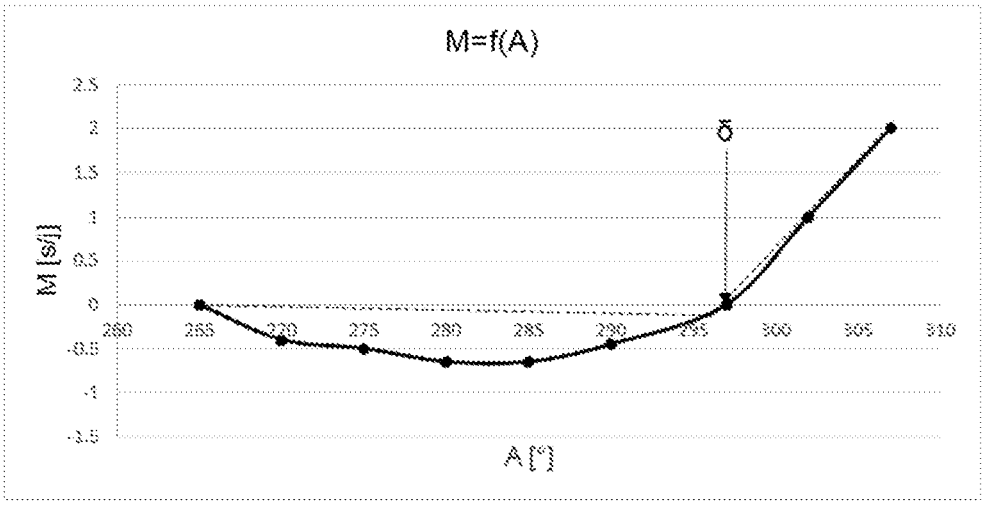
FIG. 4 is a graph representing the rate variations of the operation of a timepiece according to the amplitude of the oscillations of the regulating element of the timepiece.

Following statistical processing, these measurements made it possible to identify mode changes in the chronometric behavior of the timepiece in order to define the transition boundary between the horizontal and vertical behavior of the timepiece. To do this, after having first subtracted the theoretical effect of the unbalance in the various positions, a representation of the rate according to the amplitude M=f(A) was established as shown in FIG. 4 for example, the variations of the parameters being associated with the position variations and not with the load variations of the barrel.

More particularly, the characteristic M=f(A) was determined based on the latitude $\vartheta_j$ of the timepiece by considering a mean rate, as well as a mean amplitude for all the longitudes swept.

In other words:

$$\left.\begin{matrix} M = f(\vartheta_j) \\ A = f(\vartheta_j) \end{matrix}\right\} \rightarrow M = f(A)$$

More particularly, FIG. 4 illustrates an isochronism curve representative of a typical timepiece. The transition boundary between the horizontal and vertical behavior of the timepiece is given here when the rate difference is significant relative to a reference rate value. In other words, a "horizontal" behavior is distinguished from a "vertical" behavior by a change in slope on the isochronism curve.

A transition boundary can be defined by repeating this method for all timepieces processed. The mode change observed occurs at an orientation of an inclination δ angle, with 45°<δ<85°, starting from the position $\vartheta$=0°, and regardless of the prior orientation of the timepiece.

As far as the different vertical positions are concerned, no significant mode change was noted.

Figure 5:
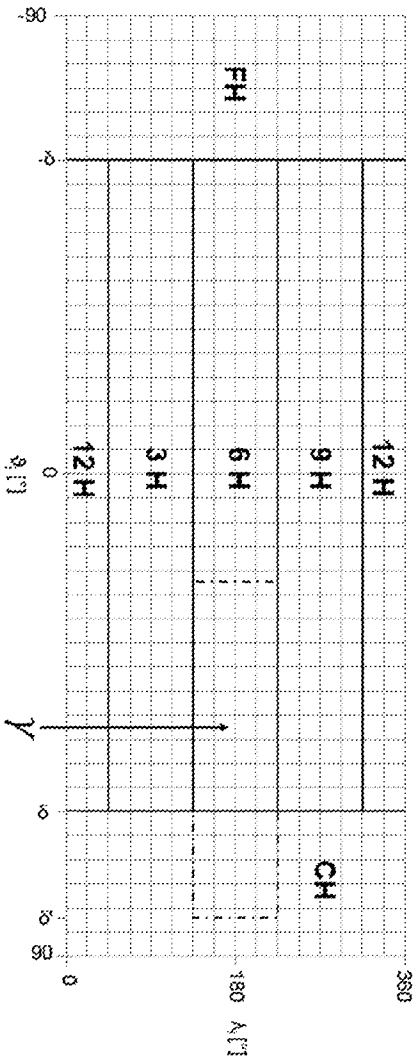
FIG. 5 is a graph representing an association example formed between any positions of a timepiece and six conventional watch positions, and an intermediate inclined position.

Knowing the transition boundary between the horizontal and vertical behavior of the timepiece, and considering that no systematic effect changes the chronometry of the timepiece regardless of its vertical position, it is possible to map "typical" operating modes, as shown in FIG. 5, which establishes a correspondence between any orientation ($\lambda_i$, $\vartheta_j$) of the timepiece and the reference watch positions. The transition between the horizontal and vertical positions is given by the angle δ. The four vertical positions correspond, for example, to the division of the remaining area into four equal portions, without counting a region that is associated with the inclined position γ.

The second study describes the orientation of the timepiece when worn, notably its orientation or its position when on the wrist of a wearer. The study therefore focused on the acquisition and the processing of position measurements when worn. By means of a series of experimental measurements, it notably enabled identification of a continuum of positions swept in a space by a panel of wearers and the probabilities or the time associated with each position of this continuum.

Following this study, it is possible to establish a map representing the probability density of the positions of the timepiece when worn by an "average wearer". The probability for each orientation field may be represented according to the longitude $\lambda_i$ and latitude $\vartheta_j$ of the timepiece. The probability by orientation field ($\lambda_i$, $\vartheta_j$) depends on the mesh fineness chosen, but the sum of the probabilities is always equivalent to 1. The sum of the probabilities $p_{\lambda_i,\vartheta_j}$ for a given orientation ($\lambda_i$, $\vartheta_j$) can thus be defined as follows:

$$\sum_{\lambda_i,\vartheta_j} p_{\lambda_i,\vartheta_j} = 1, \begin{cases} 0° \le \lambda_i < 360° \\ -90° \le \vartheta_j \le 90° \end{cases}$$

In-depth analysis of the results of this second study enabled the inclined position to be determined (γ). The map of position probability densities unexpectedly indicates a significant probability density in a particular orientation area. This represents about 30% of the wearing time measured. This area is centered on an inclined position obtained by tilting the timepiece typically 45° between the watch positions 6H and CH.

Depending on the analysis of the inventors, this may extend in the following manner:

$$20° \le \vartheta_j \le \delta'$$

Preferably:

$$\delta' = \delta$$

and:

$$\lambda = 180°$$

To validate the relevance of the position γ, the description of the data measured was analyzed and compared with and without the use of the position γ. The analysis shows that the description of the behavior of an "average wearer" with the position γ is more representative of the wearer than that not comprising the position γ. Thus, with a view to obtaining a chronometric testing or chronometric certification method for a timepiece that is the most representative when wearing the timepiece and for the "average wearer", it is advantageous to introduce the inclined position γ.

By combining the map of operating modes in FIG. 5 and those of the position probability densities, it is possible to define durations of the various storage phases to best represent actual wearing during a chronometric testing or chronometric certification method of a timepiece according to the invention. In other words, by processing, notably by summing the probabilities associated with all the positions defining a region, particularly a watch position (e.g. 9H), one can determine an operating probability of the timepiece in a mode close to the mode obtained when the timepiece is in such a position, notably in such a watch position. From this probability it is possible to deduce a storage time of the timepiece in such a position, notably in such a watch position, when implementing the process according to the invention. For example, the storage times in each phase may be proportional to the probabilities associated with each area of FIG. 5. Of course, when implementing the method with storage of the timepiece in an inclined position, a region defining a set of positions of the timepiece associated with the inclined position (region γ shown in FIG. 5) can be defined.

With the sum of the probabilities by region, defined by the angles ($\lambda_i$, $\vartheta_j$) being equal to 1, it is thus possible to express the coefficients a to g as follows:

$$a = \sum_{\lambda_i,\vartheta_j} p_{\lambda_i,\vartheta_j}$$

$$\begin{cases} \text{lower boundary position } \lambda_i < \text{upper boundary position } \gamma \\ \text{lower boundary position } \gamma < \vartheta_j < \text{upper boundary position } \gamma \end{cases}$$

$$b = \sum_{\lambda_i,\vartheta_j} p_{\lambda_i,\vartheta_j}$$

$$\begin{cases} \text{lower boundary position } 3H < \lambda_i < \text{upper boundary position } 3H \\ \text{lower boundary position } 3H < \vartheta_j < \text{upper boundary position } 3H \end{cases}$$

$$c = \sum_{\lambda_i,\vartheta_j} p_{\lambda_i,\vartheta_j}$$

$$\begin{cases} \text{lower boundary position } 6H < \lambda_i < \text{upper boundary position } 6H \\ \text{lower boundary position } 6H < \vartheta_j < \text{upper boundary position } 6H \end{cases}$$

$$d = \sum_{\lambda_i,\vartheta_j} p_{\lambda_i,\vartheta_j}$$

$$\begin{cases} \text{lower boundary position } 9H < \lambda_i < \text{upper boundary position } 9H \\ \text{lower boundary position } 9H < \vartheta_j < \text{upper boundary position } 9H \end{cases}$$

$$e = \sum_{\lambda_i,\vartheta_j} p_{\lambda_i,\vartheta_j}$$

$$\begin{cases} \text{lower boundary position } 12H < \lambda_i < \\ \quad \text{upper boundary position } 12H \\ \text{lower boundary position } 12H < \vartheta_j < \\ \quad \text{upper boundary position } 12H \end{cases}$$

$$f = \sum_{\lambda_i,\vartheta_j} p_{\lambda_i,\vartheta_j}$$

$$\begin{cases} \text{lower boundary position } FH < \lambda_i < \text{upper boundary position } FH \\ \text{lower boundary position } FH < \vartheta_j < \text{upper boundary position } FH \end{cases}$$

$$g = \sum_{\lambda_i,\vartheta_j} p_{\lambda_i,\vartheta_j}$$

$$\begin{cases} \text{lower boundary position } CH < \lambda_i < \text{upper boundary position } CH \\ \text{lower boundary position } CH < \vartheta_j < \text{upper boundary position } CH \end{cases}$$

and:

$$\sum_{\lambda_i,\vartheta_j} p_{\lambda_i,\vartheta_j} = a + b + c + d + e + f + g = 1, \begin{cases} 0° \le \lambda_i < 360° \\ -90° \le \vartheta_j \le 90° \end{cases}$$

Throughout this document, "timepiece" refers notably to a watch movement or a watch.

As in standard ISO 3158, when a timepiece does not comprise a dial, it is hypothetically assumed that it comprises a fictional dial, particularly a conventional fictional dial or a working dial. A working dial is different from the dial that is placed in the finished timepiece, but which however allows one to read a derived indication of the time at any time in order to perform a chronometric testing or chronometric certification operation.

A chronometric testing or chronometric certification device according to the invention may comprise static storage elements of at least one timepiece in at least the first position γ. Preferably, the chronometric testing or chronometric certification device further comprises static storage elements of at least one timepiece in at least one conventional watch position defined according to standard ISO 3158. Preferably, the storage elements comprise a housing of large volume in order to simultaneously accommodate several timepieces which may or may not have been previously in containers dedicated for this purpose.

At least one status data acquisition element allows status reports to be compiled from at least one timepiece between two cycles or two storage phases of the timepiece. The status reports are taken or not when the timepieces are arranged on the storage elements. Preferably, status reports preferably allow status reports to be taken simultaneously on several timepieces. Alternatively, these status reports are nearly simultaneous, thereby establishing successive reports at high speed, for example by an automatic sweep in order to obtain images of the various timepieces.

A chronometric testing or chronometric certification device according to the invention may also comprise displacement elements of at least one timepiece that are provided to sweep the timepiece in a continuum of positions in space. Preferably, they include large volume housing which can simultaneously accommodate several timepieces previously arranged or not in supports dedicated for this purpose.

The status reports are taken or not when the timepieces are arranged on the timepiece displacement elements.

Figure 6:
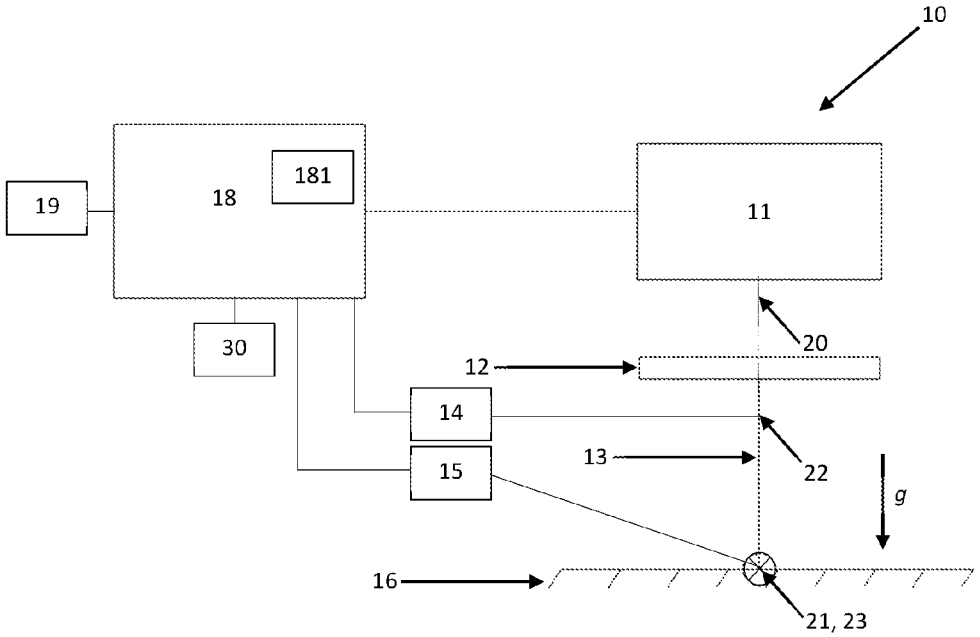
FIG. 6 is a diagram of a specific embodiment of a chronometric testing or chronometric certification device for a timepiece according to the invention.

A specific embodiment of a chronometric testing or chronometric certification device 10 of a timepiece 1 is described below with reference to FIG. 6. It allows the chronometric testing or chronometric certification method, object of the invention, to be implemented.

To do this, the device comprises hardware and/or software elements configured to implement the method of the invention, particularly the embodiment of the method described above.

The hardware elements notably include:

A frame 16,

A support 12,

A mechanical connection element 13, mechanically connecting the support to the frame, An actuating element 14, 15, including a first actuator 14 and second actuator 15, A status data acquisition element 11, including a video camera or a photographic camera or an optical sensor, A reference timebase 19, A logic processing unit 18, including a microcontroller or a microprocessor, A man-machine interface 30.

The support is adapted to receive at least one timepiece. The timepiece is secured, in a removable manner, to the support throughout the duration of the chronometric testing or chronometric certification method. Thus, the support may comprise timepiece fastening elements. Alternatively, the support may comprise fastening elements of holding adapted to include several timepieces.

The support is pivoted about an axis 20 on the mechanical connection element 13. A pivot link 22 is, for example, formed between the support and the mechanical connection element. Similarly, the mechanical connection element is pivoted about an axis 21 relative to the frame 16. A pivot link 23 is, for example, formed between the mechanical connection element and the frame. Axes 20 and 21 are preferably perpendicular.

The actuating element 14, 15 enables the mechanical connection element to move relative to the frame 16 and the support 12 to move relative to the mechanical connection element 13. In particular, the first actuator 14 enables the mechanical connection element to move relative to the support 12 and the second actuator 15 enables the mechanical connection element to move relative to the frame 16. The actuators are preferably electromechanical actuators such as geared motors and/or stepper motors controlled by the logic processing unit.

Simply put, the rotation angle of the support relative to the mechanical connection element about the axis 20 defines the longitude, and the rotation angle of the frame in relation to the mechanical connection element about the axis 21 defines the latitude. However, the axes may be arranged differently in space such that a change of a given angle of longitude or latitude must be performed by a composition of a rotation about the axis 20 and rotation about the axis 21.

The status data acquisition element 11 allows for status reports. The acquisition element can be fixedly mounted on the support. The acquisition element is controlled by the logic processing unit 18. The logic processing unit preferably triggers the acquisition of status reports. The status reports are transmitted to the logic processing unit 18, which comprises a module 181 for processing status information, notably an image processing module that determines a given time from the position of the hands of the timepiece at a given instant. The processing module may include software elements.

The logic processing unit 18 is also connected to the reference timebase 19 which allows precise determination of the time passed between two status reports of the timepiece.

The logic processing unit 18 is moreover connected to a man-machine interface 30. The interface allows the device to be controlled, notably to control or trigger the execution of the method according to the invention. The interface also allows to obtain results determined by carrying out the method, in particular to obtain operating information about the timepiece, particularly rate variation information about the timepiece.

The logic processing unit is programmed to drive the actuating element for example, so as to set in motion the timepiece so that it sweeps or not a continuum of positions in space.

An embodiment of a production or adjustment method of a timepiece according to the invention is further described below.

The method comprises an implementation step of the chronometric testing method according to the invention, particularly a mode of execution of the chronometric testing method described above.

Optionally, the method comprises, in addition to the chronometric testing step, at least one step of adjusting the timepiece. Notably, this adjustment step depends on the information provided by the chronometric testing method, such as the rate variation provided by the chronometric testing method.

The invention also relates to the timepiece 1, notably a wristwatch, obtained by the implementation of the chronometric testing or chronometric certification method according to the invention, in particular according to one of the embodiments of the chronometric testing or chronometric certification method described above, or obtained by implementing the production or adjustment method according to the invention, in particular according to the embodiment of the production or adjustment method described above.

Throughout this document, the term "storage cycle", refers to any series of multiple storage phases. A static storage cycle consists of at least one static storage phase in which the timepiece is held stationary in a predetermined position. The term "static storage phase" refers to a phase during which the timepiece is stationary in a given position. This given position may be the inclined position γ or a conventional watch position (3H, 6H, 9H, 12H, FH, CH).

A dynamic storage cycle consists of at least one dynamic storage phase wherein the timepiece sweeps a given continuum of positions in one or more given directions. A dynamic storage cycle does not include a static storage phase.

Throughout this document, the term "storage cycle" refers to any period started with a first status report of the timepiece and terminated with a subsequent status report of the timepiece, this duration being used in the chronometric testing or chronometric certification method of the timepiece. Intermediate status reports can also be made between two storage phases of the timepiece, notably in the case of a static storage cycle of the timepiece.

Throughout this document, the term "conventional dial" refers to a dial provided to cooperate with movable hands in rotation about its center, and comprising marks, notably marks 203 corresponding to the indication "3 o'clock", 206 corresponding to the indication "6 o'clock", 209 corresponding to the indication "9 o'clock", and 212 corresponding to the indication "12 o'clock". The hands turn in the anti-counterclockwise direction or clockwise as seen when facing the dial. The position angle of the hands about the center of the dial is proportional to the time. The marks 12 o'clock, 3 o'clock, 6 o'clock and 12 o'clock are arranged 90° from each other, respectively.

The notions of "oriented semi-axis" and "oriented angle" must be understood in their habitual and conventional mathematical sense. The orientation of an axis or of a semi-axis consequently establishes the orientation of the rotation about this axis or semi-axis. Conventionally, a rotation of a body about an oriented semi-axis is positive or has a positive angle when the body rotates in the clockwise direction around the semi-axis, the body being observed in the direction of the oriented semi-axis.

The invention claimed is:

1. A chronometric testing or chronometric certification method for a timepiece, comprising:

generating at least two status reports on the chronometric behavior of the timepiece respectively before and after at least a first static storage cycle in at least one predefined position of the timepiece, wherein the status reports include an image of the timepiece, wherein the at least one predefined position comprises at least a first inclined position of the timepiece, wherein in the first inclined position, a plane of a dial of the timepiece is neither parallel nor perpendicular to the Earth's gravitational field.

2. The method as claimed in claim 1, wherein the first inclined position is defined by a first angle λ and by a second angle ϑ so that λ∈[135°, 225°]and ϑ∈[20°, 85°], with:

a first direct coordinate system (O, i, j, k) with an origin (O) at the center of a dial of the timepiece, a first oriented semi-axis (Oi), horizontal and fixed in direction, a second oriented semi-axis (Oj), horizontal and fixed in direction and a third oriented semi-axis (Ok), vertical, fixed in direction and opposite the gravitational field vector, a first position of the timepiece in which the first semi-axis (Oi) passes through a 9 o'clock mark of the dial and the third semi-axis (Ok) passes through a 12 o'clock mark of the dial, any position of the timepiece is defined from the first position by a rotation of the angle λ about the second semi-axis (Oj), then a rotation of the angle ϑ about the first semi-axis (Oi), λbeing defined on an interval between 0° and 360°,ϑ being defined on an interval between −90° and 90°.

3. The method as claimed in claim 2, wherein the first position is such that the angle λ is equal to or substantially equal to 180°.

4. The method as claimed in claim 2, wherein the first angle λand the second angle ϑ are so that λ∈[135°, 225°] and ϑ∈[20°, 70°].

5. The method as claimed in claim 4, wherein the first angle λand the second angle ϑ are so that λ∈[135°, 225°] and ϑ=45°.

6. The method as claimed in claim 1, wherein at least one selected from the group consisting of:

the first static storage cycle further comprises at least one storage phase in at least one selected from the group consisting of (i) one of the conventional watch positions selected from a second 3H position (λ=90°;ϑ=0°), a third 6H position (λ=180°;ϑ=0°), a fourth 9H position (λ=270°;ϑ=0°), a fifth 12H position (λ=0°;ϑ=0°), a sixth CH position (ϑ=90°), and a seventh FH position (ϑ=−90°) and (ii) at least a second inclined position; and the method comprises a second dynamic storage cycle of the timepiece in which the timepiece sweeps a given continuum of positions.

7. The method as claimed in claim 1, wherein for a storage cycle of a duration (t), a respective storage times ($t_\lambda$), ($t_{3H}$), ($t_{6H}$), ($t_{9H}$), ($t1_{2H}$), ($t_{FH}$), ($t_{CH}$) associated with each position (λ), (3H), (6H), (9H), (12H), (FH), (CH) of the timepiece are defined as follows:

$$\Sigma t_k = t \text{ with } k \in \{\lambda, 3H, 6H, 9H, 12H, FH, CH\}$$

with:

$$\begin{cases} t_\gamma = a \cdot t \text{ with } 0.05 \le a \le 0.85 \\ t_{3H} = b \cdot t \text{ with } 0 \le b \le 1 \\ t_{6H} = c \cdot t \text{ with } 0 \le c \le 1 \\ t_{9H} = d \cdot t \text{ with } 0 \le d \le 1 \\ t_{12H} = e \cdot t \text{ with } 0 \le e \le 1 \\ t_{FH} = f \cdot t \text{ with } 0 \le f \le 1 \\ t_{CH} = g \cdot t \text{ with } 0 \le g \le 1 \end{cases}$$

8. The method as claimed in claim 7, wherein:

$$\begin{cases} 0.3 \le b + c + d + e \le 0.85 \\ 0.1 \le f + g \le 0.4 \end{cases}$$

9. The method as claimed in claim 7, wherein:

$$\begin{cases} a \neq b \\ a \neq c \\ a \neq d \\ a \neq e \\ a \neq f \\ a \neq g \end{cases}$$

10. The method as claimed in claim 1, wherein at least one selected from the group consisting of:

at least one selected from the group consisting of the temperature and pressure conditions change over the duration (t) of the storage cycle, and an auxiliary watch function is activated during at least part of the duration (t) of the storage cycle.

11. The method as claimed in claim 10, wherein at least one selected from the group consisting of the temperature and pressure conditions change over the duration (t) of the storage cycle, depending on the storage phases of the timepiece.

12. The method as claimed in claim 10, wherein an auxiliary watch function, which is a chronograph function or a calendar function, is activated during at least part of the duration (t) of the storage cycle.

13. The method as claimed in claim 1, wherein a rate variation of the timepiece is measured and given by the time difference between:

a time difference between two display values of the timepiece during at least two status reports of the timepiece, and a time difference between the instants of the at least two status reports of the timepiece, given by a reference timebase.

14. A production or adjustment method of a timepiece, the method comprising:

providing a timepiece, and implementing the chronometric testing method according to claim 1 on the timepiece.

15. The production or adjustment method as claimed in claim 14, the method comprising adjusting the timepiece at least once.

16. A timepiece obtained by implementing the method as claimed in claim 1.

17. A chronometric testing or chronometric certification device of a timepiece, comprising hardware elements and/or software configured to implement a chronometric testing or chronometric certification method for a timepiece, comprising:

generating at least two status reports on the chronometric behavior of the timepiece respectively before and after at least a first static storage cycle in at least one predefined position of the timepiece, wherein the status reports include an image of the timepiece, wherein the at least one predefined position comprises at least a first inclined position of the timepiece, wherein in the first inclined position, a plane of a dial of the timepiece is neither parallel nor perpendicular to the Earth's gravitational field.

18. The device as claimed in claim 17, comprising static storage elements of at least one timepiece in at least the first position.

19. The device as claimed in claim 17, comprising displacement elements of the timepiece to sweep the timepiece in a continuum of positions in space.

20. The device as claimed in claim 19, wherein the displacement elements comprise a system having at least one axis of rotation.

21. A chronometric testing or chronometric certification method for a timepiece, comprising:

generating at least two status reports on the chronometric behavior of the timepiece respectively before and after at least a first static storage cycle in at least one predefined position of the timepiece, the at least one predefined position comprising at least a first inclined position of the timepiece, wherein at least one selected from the group consisting of:

at least one selected from the group consisting of the temperature and pressure conditions change over the duration (t) of the storage cycle, and an auxiliary watch function is activated during at least part of the duration (t) of the storage cycle.

22. The method as claimed in claim 21, wherein at least one selected from the group consisting of the temperature and pressure conditions change over the duration (t) of the storage cycle, depending on the storage phases of the timepiece.

23. The method as claimed in claim 21, wherein an auxiliary watch function, which is a chronograph function or a calendar function, is activated during at least part of the duration (t) of the storage cycle.

* * * * *